US011613034B2

(12) United States Patent
Whitaker et al.

(10) Patent No.: US 11,613,034 B2
(45) Date of Patent: Mar. 28, 2023

(54) SHAVING DEVICE WITH PIVOTABLE LIQUID FLOW MANIFOLD

(71) Applicant: Mark A. Whitaker, Barrington, IL (US)

(72) Inventors: Mark A. Whitaker, Barrington, IL (US); Abigail L. Whitaker, Barrington, IL (US)

(73) Assignee: Mark A. Whitaker, Barrington, IL (US)

( * ) Notice: Subject to any disclaimer, the term of this patent is extended or adjusted under 35 U.S.C. 154(b) by 35 days.

(21) Appl. No.: 17/170,566

(22) Filed: Feb. 8, 2021

(65) Prior Publication Data

US 2021/0245381 A1 Aug. 12, 2021

Related U.S. Application Data

(60) Provisional application No. 62/971,437, filed on Feb. 7, 2020.

(51) Int. Cl.

| | |
|---|---|
| ***B26B 21/44*** | (2006.01) |
| ***B26B 21/52*** | (2006.01) |
| ***B26B 21/22*** | (2006.01) |

(52) U.S. Cl.

CPC ..... *B26B 21/446* (2013.01); *B26B 21/225* (2013.01); *B26B 21/521* (2013.01)

(58) Field of Classification Search

None

See application file for complete search history.

(56) References Cited

U.S. PATENT DOCUMENTS 4,177,556 A * 12/1979 Galli, Jr. ..... B26B 21/4062 30/41
4,205,441 A * 6/1980 Turner ..... B26B 21/446 30/41.5
4,228,586 A * 10/1980 Thierry ..... B26B 21/446 30/41
4,370,807 A * 2/1983 O'Neill ..... B26B 19/44 30/43.6
4,633,585 A 1/1987 Whitaker et al.
4,733,468 A * 3/1988 Zadro ..... A47G 1/02 30/41.5
5,177,870 A 1/1993 Jursich et al.
(Continued)

FOREIGN PATENT DOCUMENTS

WO 2018182391 A1 10/2018

*Primary Examiner* — Hwei-Siu C Payer

(57) ABSTRACT

A handle for a shaving device including a main portion; a nozzle for introducing a liquid into a cavity within the main portion; and at least one liquid conduit portion that is in fluid communication with the cavity. Additionally, the handle also includes a liquid dispensing manifold with at least one liquid inlet that is in fluid communication with the liquid conduit portion, wherein the liquid dispensing manifold includes at least one liquid outlet, and further wherein the at least one liquid outlet is in fluid communication with the at least one liquid inlet. Finally, the handle also preferably includes: a first cartridge connecting mechanism that is configured and arranged to be connected with a handle receiving portion provided on a blade cartridge; and a second cartridge connecting mechanism that is configured and arranged to be connected with a manifold receiving portion provided on a blade cartridge.

20 Claims, 11 Drawing Sheets

(56) References Cited

U.S. PATENT DOCUMENTS

| | | | | |
|---|---|---|---|---|
| 5,673,485 | A * | 10/1997 | Hill | B26B 21/446 30/535 |
| 6,305,082 | B1 * | 10/2001 | Troncoso | B26B 21/40 30/41 |
| 7,007,390 | B2 * | 3/2006 | Mislove | B26B 21/40 30/41 |
| 7,043,842 | B1 * | 5/2006 | Taylor | B26B 21/44 30/41.5 |
| 7,788,810 | B2 * | 9/2010 | Noble | B26B 21/44 30/41 |
| 8,438,735 | B2 * | 5/2013 | De Klerk | B26B 21/446 30/41 |
| 2011/0146080 | A1 * | 6/2011 | Pauw | B26B 21/446 30/526 |
| 2021/0245381 | A1 * | 8/2021 | Whitaker | B26B 21/446 |

* cited by examiner

SHAVING DEVICE WITH PIVOTABLE LIQUID FLOW MANIFOLD

The present utility application claims priority to U.S. Provisional Patent Application No. 62/971,437, which was filed on Feb. 7, 20212020, which is hereby incorporated by reference in its entirety.

BACKGROUND

The removal of unwanted hair from the human body is a well-known problem around the world. There are many variations of shaving systems, one of which are shaving devices that provide a continuous flow of liquid across shaving blades. Users of shaving devices providing a continuous flow of liquid across the shaving blades generally experience a more comfortable and closer shave compared to other methods. First, the warm liquid flowing across their skin not only feels good, but also hydrates and softens the unwanted hairs and underlying skin allowing for a closer and more comfortable shave. Also, the continuous flow of liquid provides lubrication and hydration during every stroke of the shaving process. In contrast, shaving creams or gels applied to the skin are removed with each stroke of the razor, thus leaving the skin unprotected and cold during subsequent shaving strokes. Another benefit of these types of shaving devices is that the continuous flow of liquid across the blades keeps the blades of the shaving cartridge clean during shaving and also prevents buildup of debris between the blades of the shaving cartridge, thus improving the useful life of the cartridge.

Various attempts have been made to provide a shaving device providing a continuous flow of liquid. Examples can be seen in U.S. Pat. No. 4,633,585 issued to Whitaker on Jan. 6, 1987 and U.S. Pat. No. 5,177,870 issued to Jursich on Jan. 12, 1993. These types of shaving devices provide a continuous flow of liquid, but connect with a blade cartridge in a way that does not allow for the pivoting action provided by modern shaving cartridges.

International Publication Number WO 2018/182391 (Apr. 10, 2018 Gazette 2018/40) discloses a shaving device providing a continuous flow of liquid that works in conjunction with a pivoting blade cartridge. However, the liquid flow provided by this shaving device does not stay consistent to the orientation of the shaving blades. The water flows in only one orientation, while the blade cartridge pivots. This results in irregular liquid flow patterns across the blades, which may result in less efficient hydration, warming and softening of the skin, as well as less efficient cleaning of the blades.

Consumers trust, prefer, and develop high degrees of loyalty to brand name blade cartridges. And thus another shortcoming the device described in International Publication Number WO 2018/182391 (Apr. 10, 2018 Gazette 2018/40) is that it requires the use of a blade cartridge specifically designed for use with the shaving device, without enabling the user to use one of the commonly available brand name blade cartridges.

It is apparent that a need exists for a shaving device providing a continuous flow of liquid that works with pivoting blade cartridges that are not specifically designed for use with a shaving device providing a continuous flow of liquid, and also provides a flow of liquid in a consistent orientation to the shaving blades. The present invention is directed toward providing such a shaving device.

BRIEF SUMMARY OF THE INVENTION

The present invention comprises a novel shaving device comprising a handle, a liquid dispensing manifold, and an intermediate liquid conduit that provides a means for liquid to flow from the handle to the liquid dispensing manifold.

Liquid flows from a source, preferably water from a household shower or faucet, into the handle by means of a flexible feed tube which is connected to the liquid entry end of the handle. Liquid flows through the handle, into the intermediate liquid conduit, and then into the liquid dispensing manifold. The liquid dispensing manifold is removably connected to a pivoting blade cartridge, and directs the flow of liquid towards the blades of a pivoting blade cartridge. It is also contemplated that the liquid could flow from a container, such as by providing the container at a higher elevation than the handle, thereby allowing gravity to provide the necessary force to direct the liquid out of the container.

The intermediate liquid conduit provides a means to maintain the liquid dispensing manifold in a consistent orientation relative to the blades of a pivoting blade cartridge.

The various objects and advantages of the invention will be better understood upon considering the following detailed description taken in conjunction with the drawings.

BRIEF DESCRIPTION OF THE DRAWINGS

Preferred embodiments of the present invention are described herein with reference to the drawings wherein:

Referring to FIGS. 1 and 2, one embodiment of a shaving device 10 is shown. The shaving device 10 includes a main portion of a handle 12, a liquid dispensing manifold 14 and one or more intermediate liquid conduits 16*a* and 16*b*.

Figure 1:
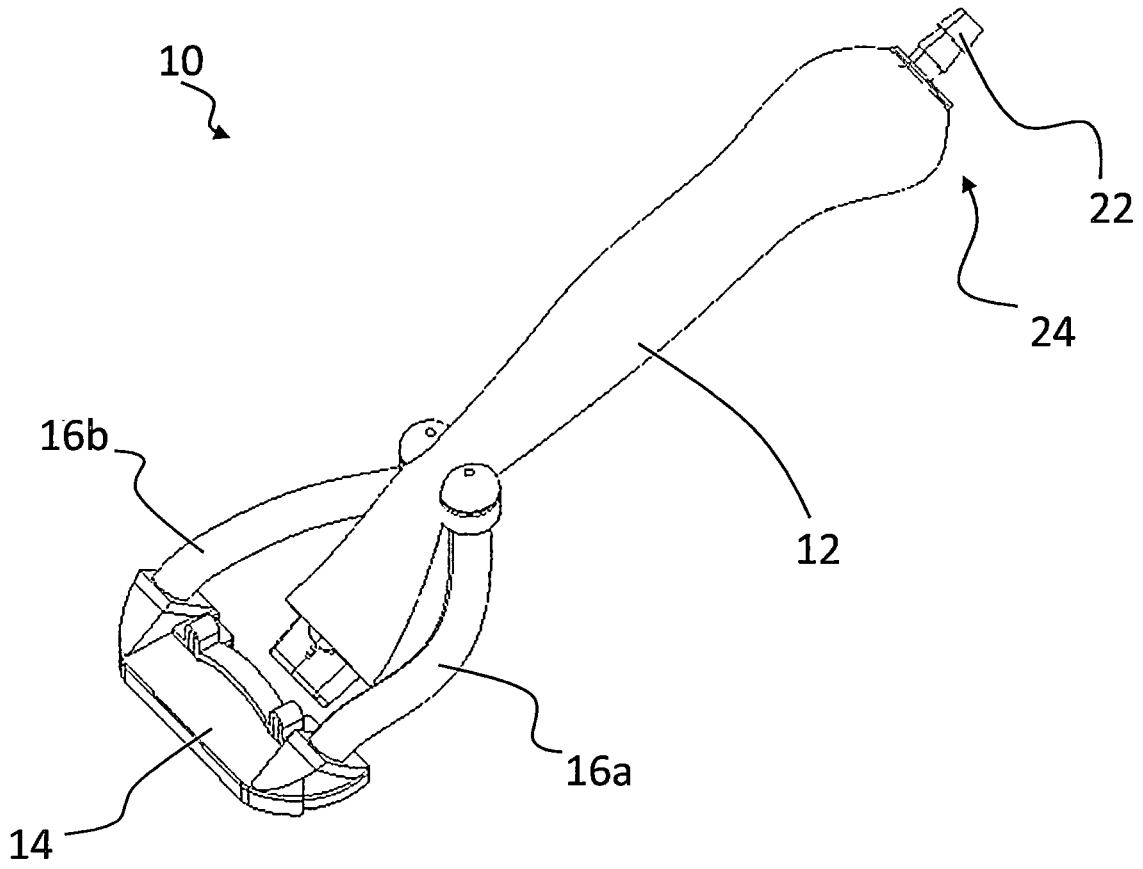
FIG. 1 is an illustrative, expanded view of one embodiment of the shaving device.
Figure 2:
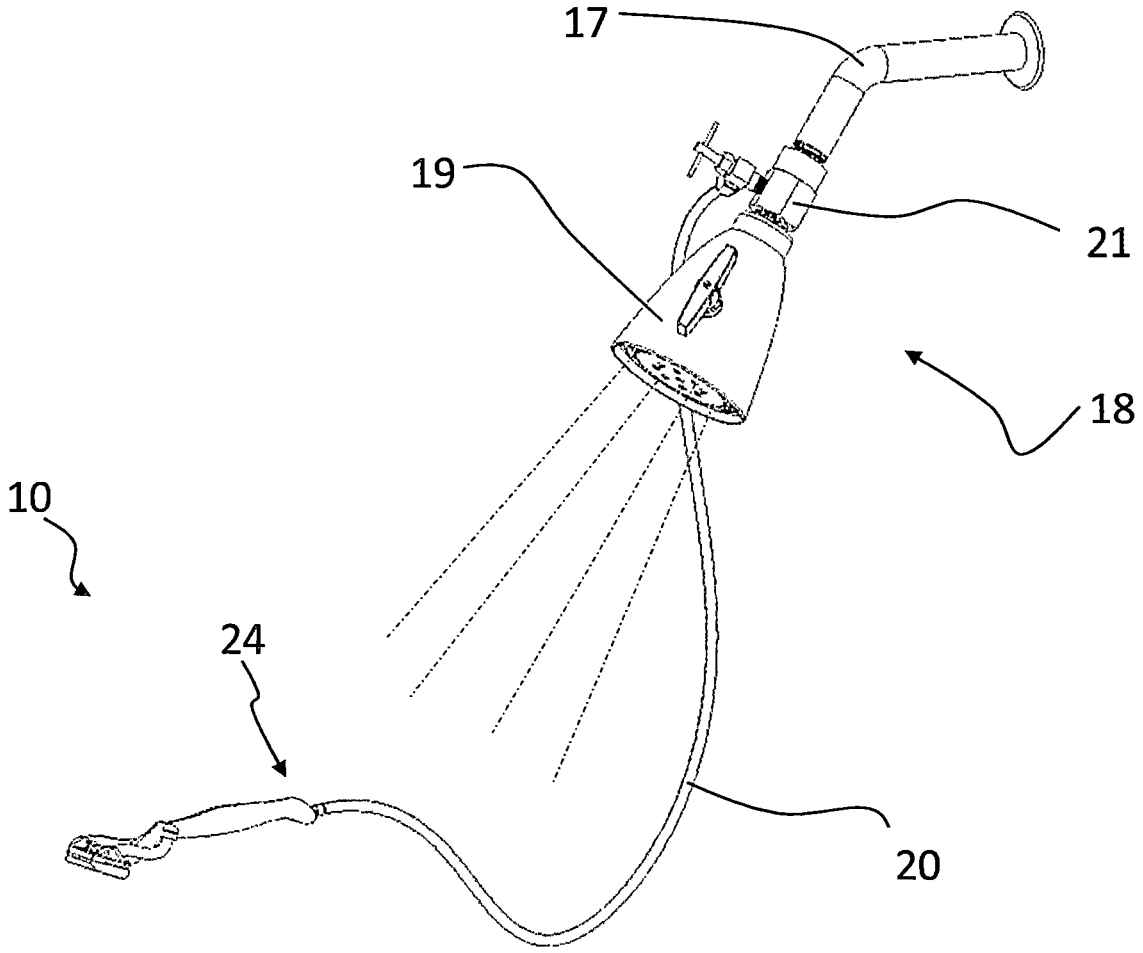
FIG. 2 is an environmental view of the shaving device showing a household shower, a flow control valve, and a flexible feed tube.
Figure 3:
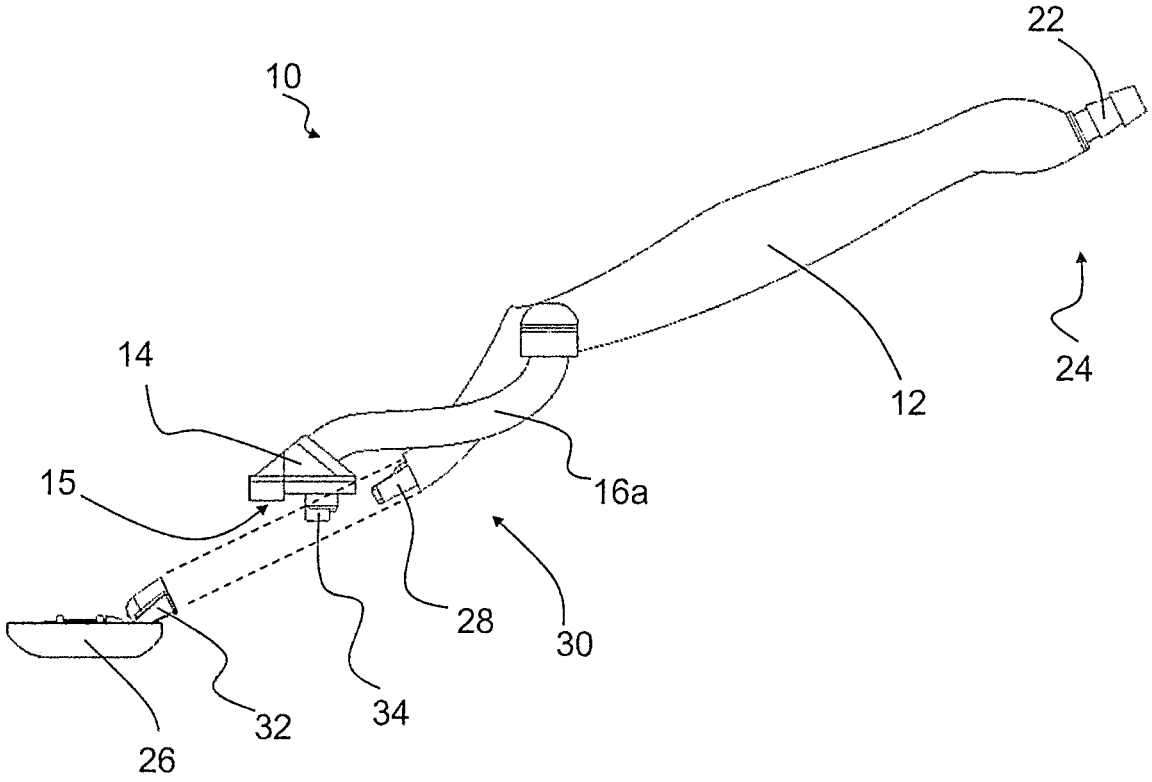
FIG. 3 is an exploded side view of the shaving device with a pivoting blade cartridge disconnected from the handle.
Figure 4:
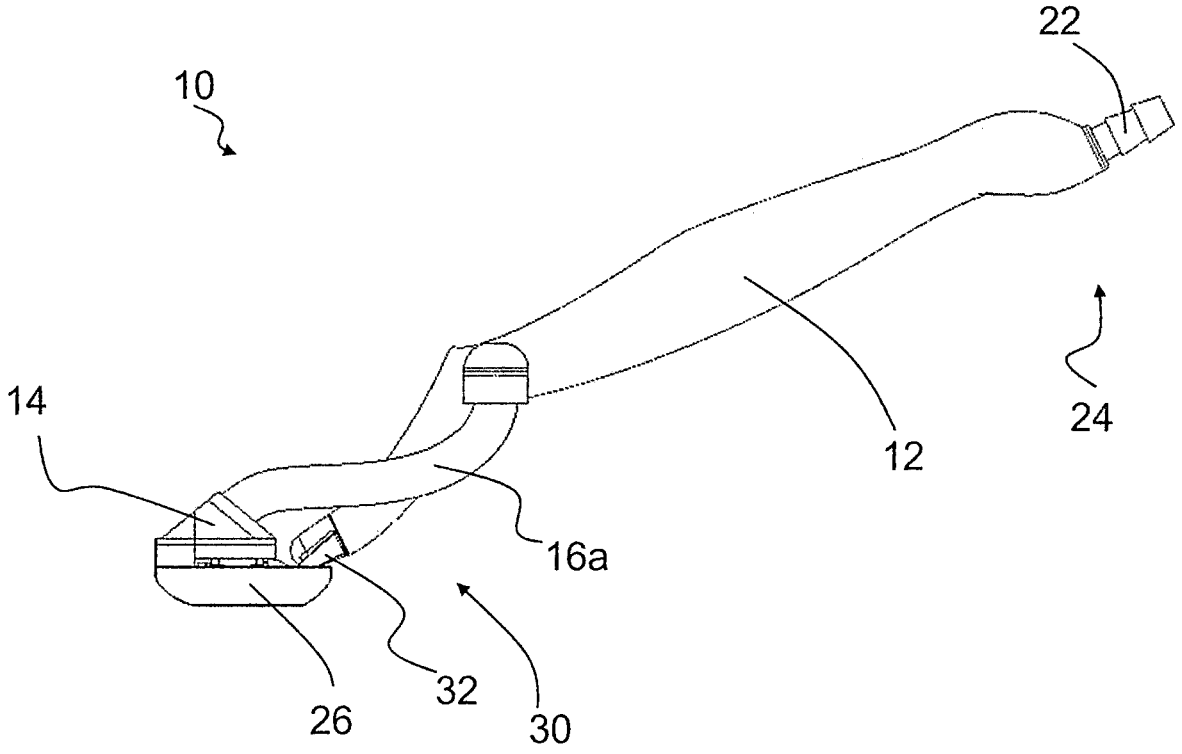
FIG. 4 is a side view of the shaving device with a pivoting blade cartridge removably connected to the handle.
Figure 5:
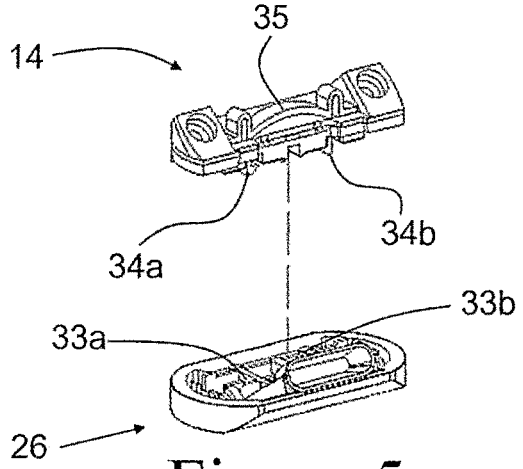
FIG. 5 is an exploded expanded view of the liquid dispensing manifold disconnected from a pivoting blade cartridge.
Figure 7:
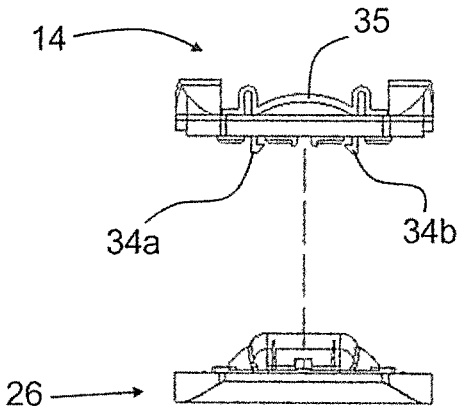
FIG. 7 is a front exploded view of the liquid dispensing manifold disconnected from a pivoting blade cartridge.
Figure 6:
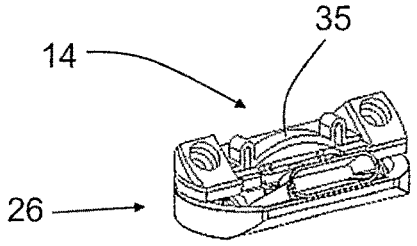
FIG. 6 is an expanded view of the liquid dispensing manifold removably connected to a pivoting blade cartridge.
Figure 8:
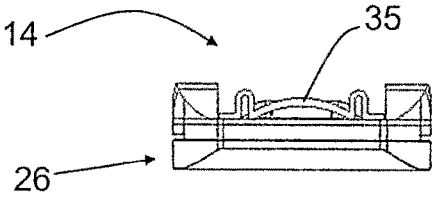
FIG. 8 is a front view of the liquid dispensing manifold removably connected to a pivoting blade cartridge.

Liquid, preferably warm water, flows from a source, preferably a household shower 18, into the handle 12, by means of a flexible feed tube 20 that is connected to a nozzle 22 located at the liquid entry end 24 of the handle 12. The main portion of the handle is configured and arranged to be gripped by a user, wherein the main portion extends from a first end portion (towards the left of FIG. 1) to a second end portion (towards the right of FIG. 1). Liquid flows into the flexible feed tube 20 from a flow control valve 21 that is installed between the shower feed pipe 17 and the shower head 19. Liquid flows through the main portion of the handle 12, into the intermediate liquid conduits 16*a* and 16*b*, and then into the liquid dispensing manifold 14. The liquid dispensing manifold 14 directs the flow of liquid towards the blades of a pivoting blade cartridge, such as cartridge 26 shown in FIG. 4. Preferably, the pivoting blade cartridge includes a cartridge housing and one or more blades that are supported by the cartridge housing. When more than one blade is provided in the cartridge, the blades are preferably arranged in parallel to each other, with the cutting edges of each of the blades facing the same direction.

FIGS. 3, 4, 5, 6, 7, and 8 illustrate how the shaving device 10 removably connects to a pivoting blade cartridge 26. Liquid flows from the nozzle 22, through the main portion of the handle 12, into the intermediate liquid conduits 16*a*, 16*b*, and then into the liquid dispensing manifold 14. A pivoting blade cartridge 26 is removably connected to the cartridge mating side 15 of the liquid dispensing manifold 14 of the shaving device 10. For illustration purposes, the pivoting blade cartridge 26 shown herein is a commercially available Gillette® Venus 5, but other pivoting cartridges from Gillette, as well as from other brands, are also suitable for use with the present invention. The pivoting blade cartridge 26 is connected to the shaving device 10 in two methods. First, a cartridge connecting feature (or mechanism) 28 protrudes from the blade cartridge end 30 of the handle 12. The first cartridge connecting feature 28 is removably connected with a handle receiving feature 32 of the pivoting blade cartridge 26. This is illustrated by the dotted lines in FIG. 3. Again for illustration purposes, the Gillette Venus 5 blade cartridge provides a female handle receiving feature 32 that receives the male cartridge connecting feature 28 of the handle. Features are formed into the connecting feature 28 so that when the connecting feature 28 is fully inserted into the handle receiving feature 32, a removable snap-fit connection is made.

Second, the liquid dispensing manifold 14 is removably connected to the pivoting blade cartridge 26. For illustrative, non-limiting purposes, the pivoting blade cartridge 26 is removably connected to the liquid dispensing manifold 14 by means of a second cartridge connecting mechanism 34, such as one or more snap features 34*a* and 34*b* which protrude from the liquid dispensing manifold 14, and create a snap-fit connection with available features 33*a* and 33*b* of the pivoting blade cartridge 26, where connection features 33*a* and 33*b* are one example of manifold receiving portion (or mechanism). A release button 35 is provided on the liquid dispensing manifold 14 that when pressed, disengages the snap features 34*a* and 34*b* from the pivoting blade cartridge 26 thereby disconnecting the shaving device 10 from the pivoting blade cartridge 26. More specifically, the release button 35 is bowed, such that when pressed towards the liquid dispensing manifold 14, the release button 35 forces the snap features 34*a* and 34*b* apart from each other, thus widening the space between them. The wider space between the snap features 34*a* and 34*b* disengages the snap-fit connection with the available features 33*a* and 33*b* of the pivoting blade cartridge 26, and thereby disconnects the shaving device 10 from the pivoting blade cartridge 26.

Figure 9:
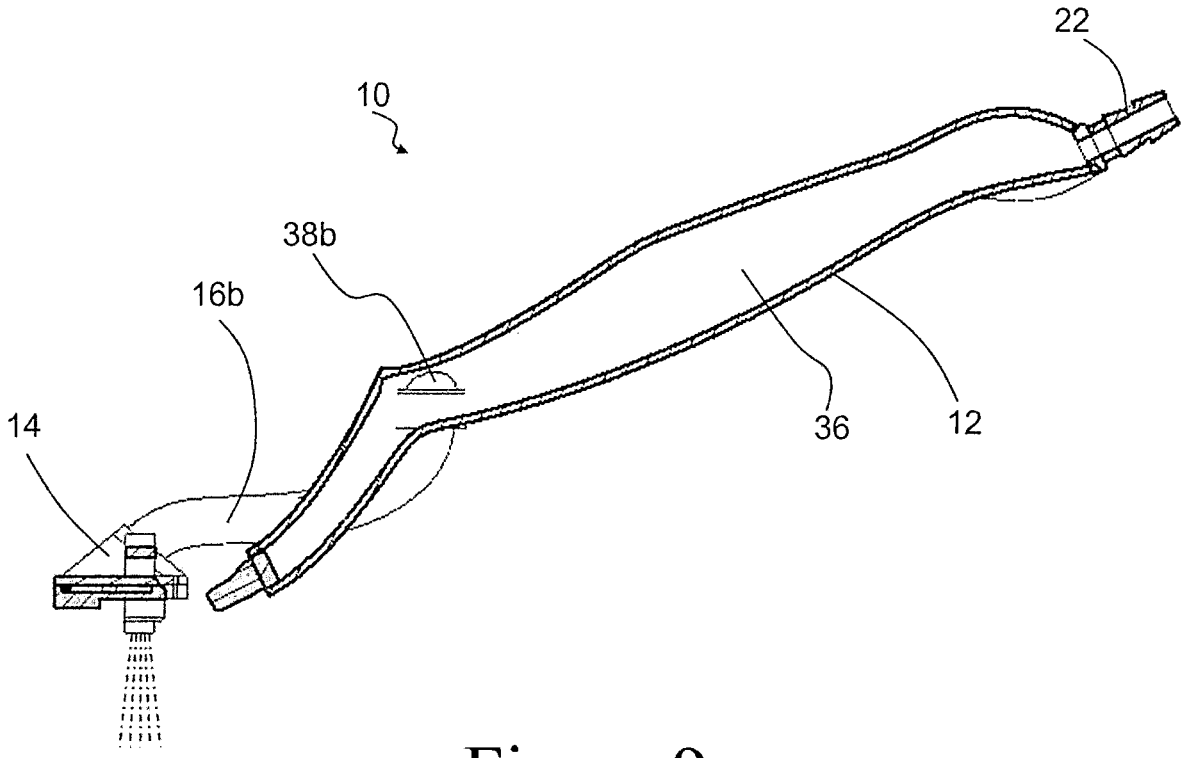
FIG. 9 is a cross-sectional view of one embodiment of the shaving device.

FIG. 9 shows a section view of the shaving device 10 without a blade cartridge. Liquid enters the main portion of the handle 12 through the nozzle 22 and fills up the hollow cavity 36 of the main portion of the handle 12. Liquid can only exit the hollow cavity 36 through one or more exit ports 38*a* and 38*b* which are in fluid communication with the intermediate liquid conduits 16*a* and 16*b*. Liquid then flows through the intermediate liquid conduits 16*a* and 16*b*, into the liquid dispensing manifold 14, and then exits the shaving device 10 through the liquid dispensing manifold 14 as illustrated by the dotted lines.

Figure 10:
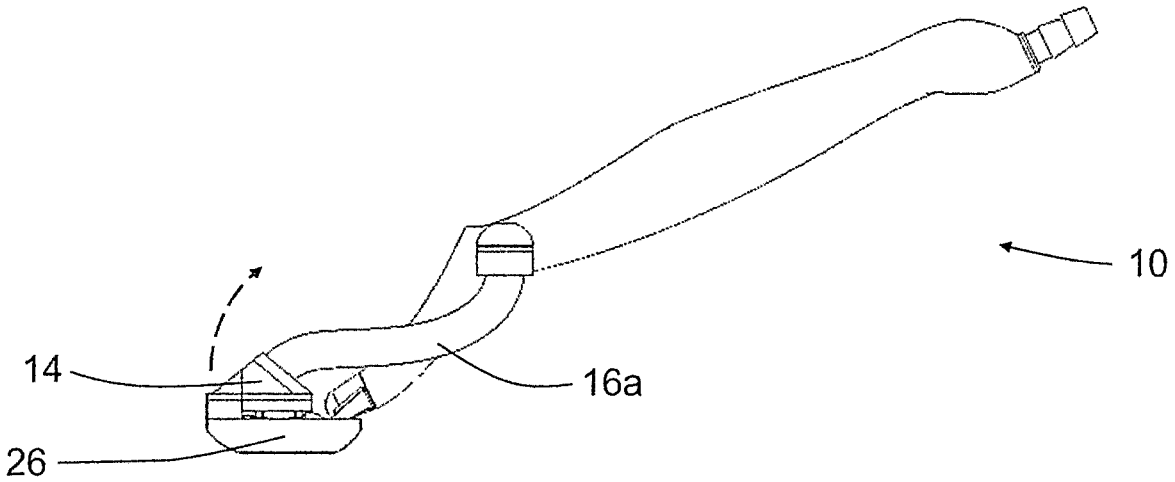
FIG. 10 is a side view of the shaving device with the pivoting blade cartridge at its minimum pivot orientation.
Figure 11:
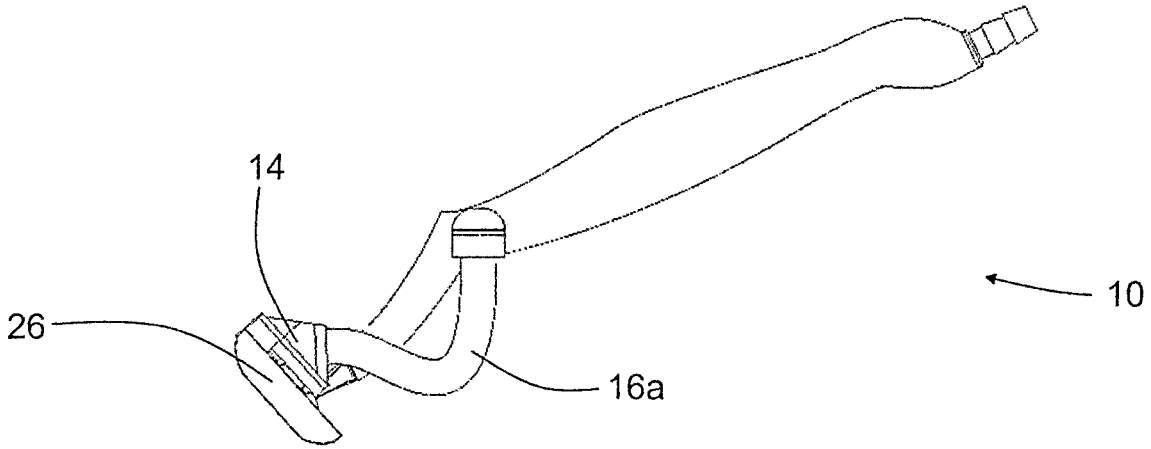
FIG. 11 is a side view of the shaving device with the pivoting blade cartridge at its maximum pivot orientation.

FIGS. 10 and 11 illustrate how one embodiment of the shaving device 10 provides a flow of liquid in a consistent orientation to the shaving blades of a pivoting blade cartridge 26. Intermediate liquid conduits 16*a* provide a means for liquid to pass from the handle 12 into the liquid dispensing manifold 14. In this embodiment, the intermediate liquid conduits 16 are made from flexible tubing. Suitable tubing materials include, but are not limited to, plastics such as polyethylene, polypropylene, blends of plastics, Polytetrafluoroethylene, and Polyvinyl chloride; and rubbers including silicone, latex and gum. The diameter of the flexible tubing should be large enough that an adequate flow of liquid is provided, but small enough that the tubing does not interfere with the pivoting action of the pivoting blade cartridge 26. A suitable, but non-limiting, range of inside tubing diameters is from about 2.0 to about 8.0 mm. One such tubing is E-1000 Ultra Soft Tygon Tubing available from Saint-Gobain North America of Malvern, Pa. For the shaving device 10 to work properly, it is important that both the pivoting blade cartridge 26 and liquid dispensing manifold 14 pivot on the same axis. The pivot axis is defined by the pivoting blade cartridge 26. The use of flexible tubing as the material for the intermediate liquid conduits 16*a* allows the liquid dispensing manifold 14 to remain in a consistent orientation to the pivoting blade cartridge 26 throughout its minimum and maximum pivot orientations. FIG. 10 depicts the shaving device 10 with the pivoting blade cartridge 26 at its minimum pivot orientation, while FIG. 11 depicts the shaving device 10 with the pivoting blade cartridge at its maximum pivot orientation. The intermediate liquid conduits 16*a* should not only bend in response to movement of the pivoting blade cartridge 26, but should also provide an appropriate amount of resistance to the movement of the pivoting blade cartridge 26. It is important that the intermediate liquid conduits 16*a* in this embodiment offer the correct amount of flexibility. Materials that are too stiff will prevent proper pivoting of the pivoting blade cartridge 26. Materials that are too flexible will not provide sufficient resistance to the pivoting action of the pivoting blade cartridge 26. The preferred range of flexibility is between Shore A durometers 40 and 80.

Figure 12:
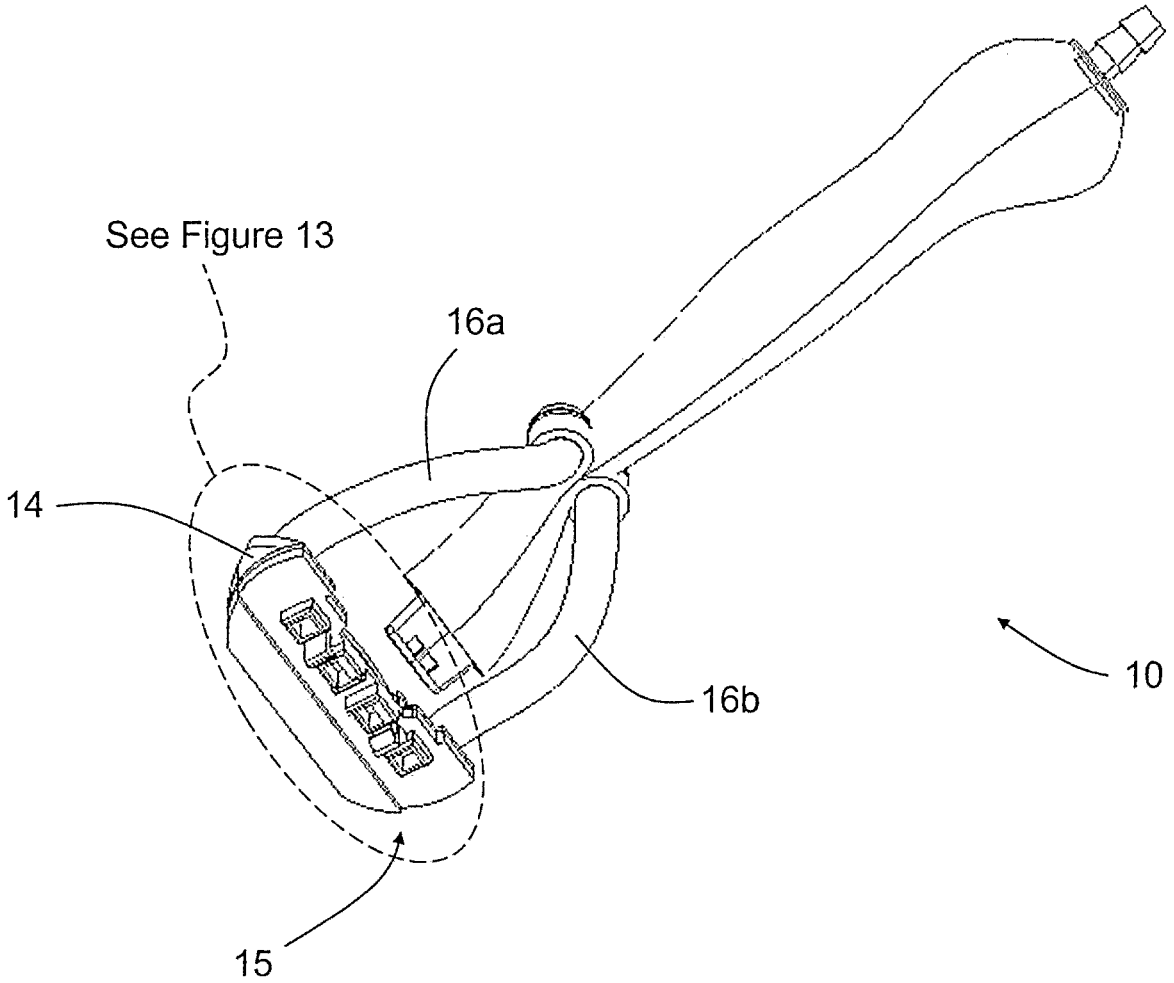
FIG. 12 is a perspective view of the shaving device where the cartridge mating side of the liquid dispensing manifold can be viewed.
Figure 13:
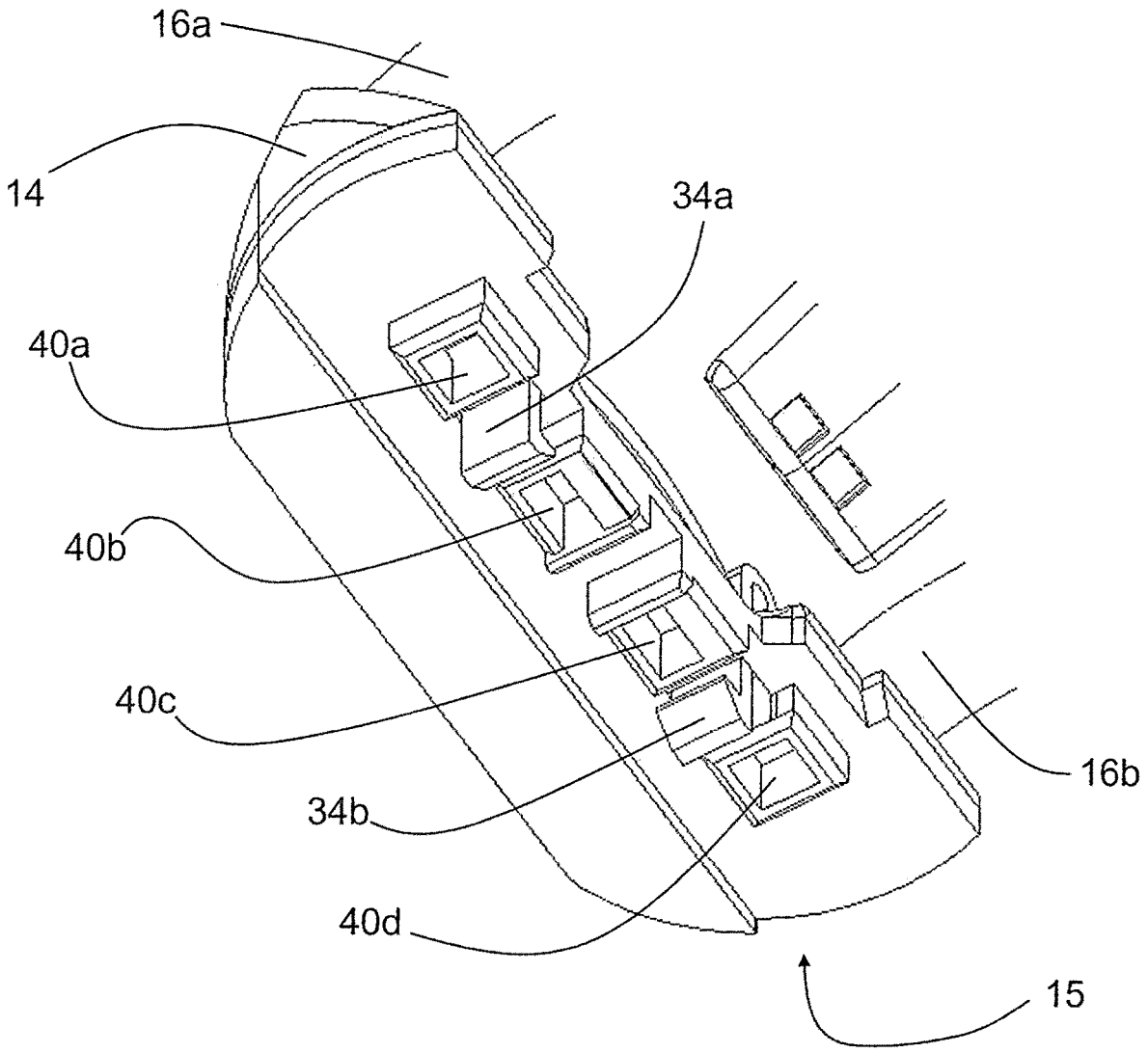
FIG. 13 is a close-up perspective view of cartridge mating side of the liquid dispensing manifold taken along the dotted line in FIG. 12.
Figure 14:
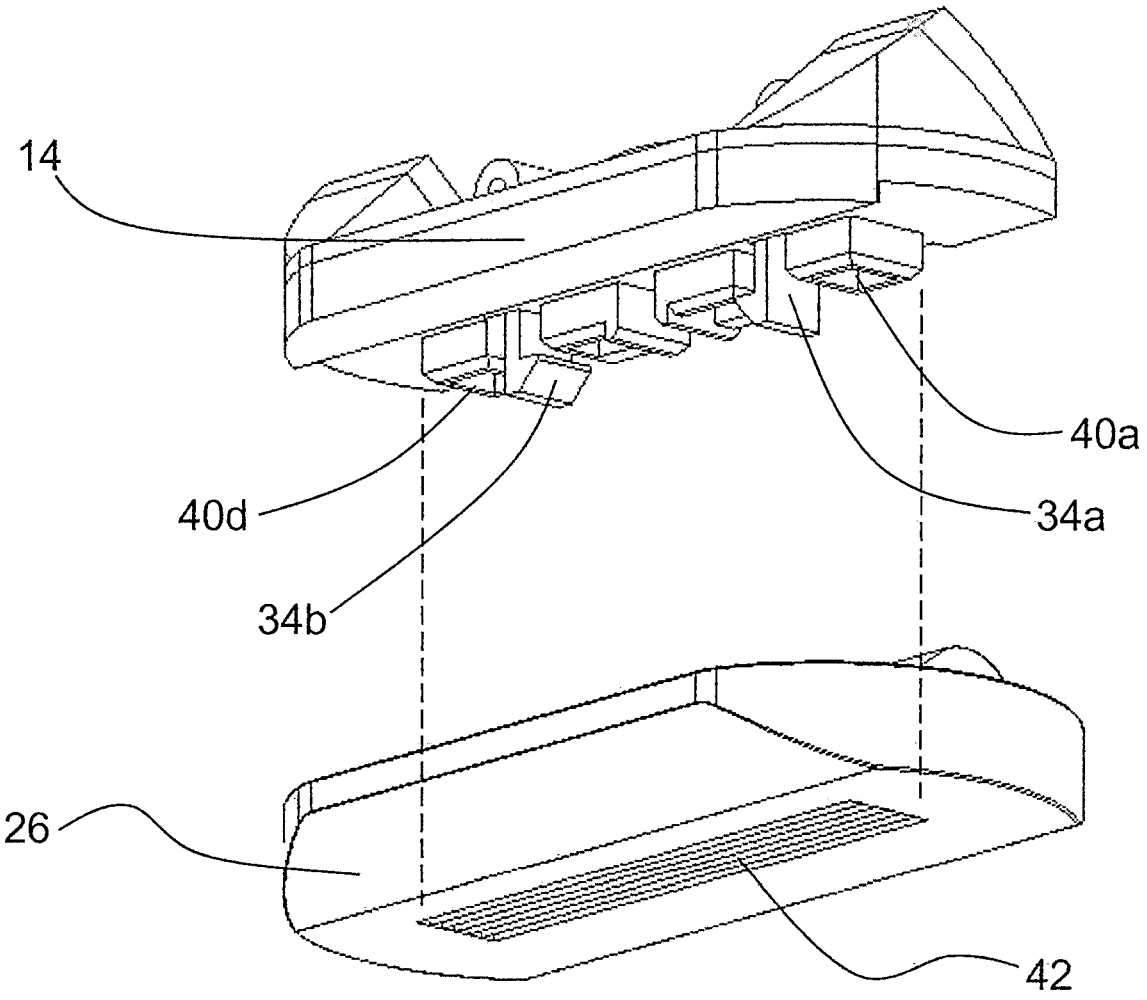
FIG. 14 is an exploded expanded view of the liquid dispensing manifold disconnected from a pivoting blade cartridge showing the relative alignment of the liquid outlets to the blades.

FIGS. 12 and 13 show a perspective view of the shaving device 10 where the cartridge mating side 15 of the liquid dispensing manifold 14 can be viewed. Liquid flows from the intermediate liquid conduits 16*a* and 16*b* into the liquid dispensing manifold 14. Liquid exits the liquid dispensing manifold 14 through one or more liquid outlets 40*a*, 40*b*, 40*c* and 40*d* which are aligned with the blades 42 of a pivoting blade cartridge 26 as shown by the dotted lines in FIG. 14. Although four liquid outlets are shown in this embodiment, it is contemplated that a single elongated outlet, a pair of outlets, three outlets, or more than four outlets could be used. Liquid thus flows across the blades 42 in a precise and consistent orientation to the blades 42 of the pivoting blade cartridge 26.

Figure 15:
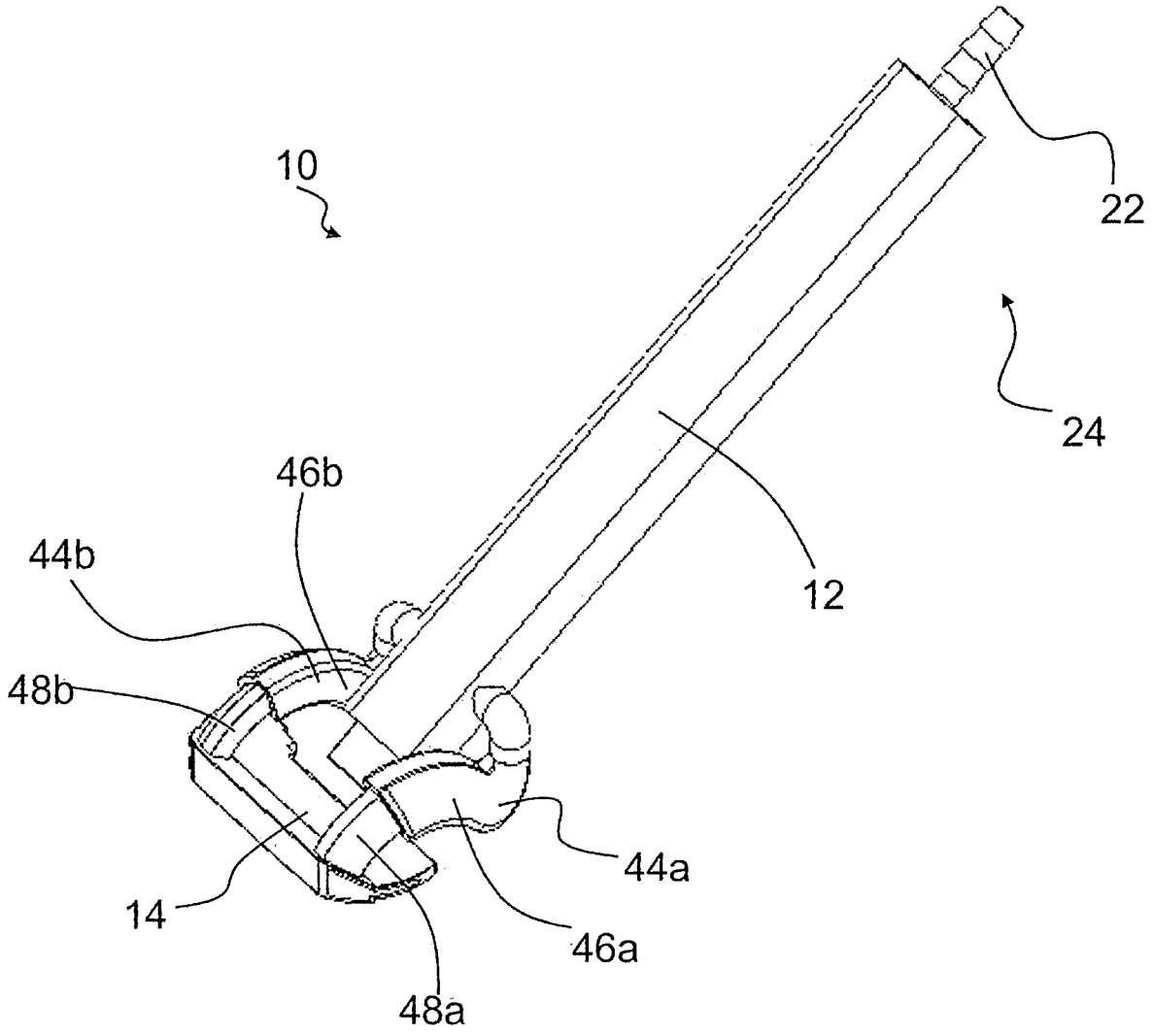
FIG. 15 is an illustrative, expanded view of another embodiment of the shaving device.

FIG. 15 illustrates a second embodiment of a shaving device 10. One or more telescoping conduits 44*a* and 44*b* replace the intermediate liquid conduits 16*a* and 16*b* of FIGS. 1 through 14, and provide a means for liquid to flow from the handle 12 to the liquid dispensing manifold 14. The telescoping conduits 44*a* and 44*b*, which are preferably made of a relatively rigid material, such as a rigid plastic or a resin coated metal, consist of outer tubes 46*a* and 46*b* and inner tubes 48*a* and 48*b*. The outer tubes 46*a* and 46*b* are in fluid communication with the main portion of the handle 12 and the inner tubes 48*a* and 48*b*. The inner tubes 48*a* and 48*b* are in fluid communication with the liquid dispensing manifold 14, and can slide back and forth inside of the outer tubes 46*a* and 46*b*, thus allowing the liquid dispensing manifold 14 to remain in a consistent orientation to the shaving blades 42 of a pivoting blade cartridge 26. Proper clearance should be provided between the inner tubes 48*a* and 48*b* and the outer tubes 46*a* and 46*b*. The clearance should be large enough to allow for smooth telescoping movement of the tubes, but also small enough as to not allow too much liquid to leak through the clearance gap. The preferred range of clearance is between about 0.15 and about 0.25 millimeters.

Other than the features described above in the previous paragraph, the remainder of the features of this second embodiment are essentially the same as those of the first embodiment.

The foregoing is a complete description of the shaving device. Many changes and modifications may be made to the foregoing without departing from the spirit and scope encompassed by the foregoing description.

What is claimed is:

1. A handle for a shaving device comprising:

a main portion configured and arranged to be gripped by a user, wherein the main portion extends from a first end portion to a second end portion thereof;

a nozzle positioned near the second end portion of the main portion of the handle, wherein the nozzle is configured and arranged to introduce a liquid into a cavity within the main portion of the handle;

at least one liquid conduit portion including a proximal end that is in fluid communication with the cavity of the main portion;

a liquid dispensing manifold including a proximal side and a distal side and at least one liquid inlet that is in fluid communication with a distal end of the at least one liquid conduit portion, wherein the liquid dispensing manifold includes at least one liquid outlet, wherein the at least one liquid outlet is in fluid communication with the at least one liquid inlet, and further wherein the at least one liquid outlet is open to the distal side of the manifold;

a first cartridge connecting mechanism provided on the first end portion of the main portion, wherein the first cartridge connecting mechanism is configured and arranged to be connected with a handle receiving portion provided on a blade cartridge; and a second cartridge connecting mechanism provided on the distal side of the liquid dispensing manifold, wherein the second cartridge connecting mechanism is configured and arranged to be connected with a manifold receiving portion provided on the blade cartridge.

2. The handle according to claim 1, wherein:

the at least one liquid conduit portion comprises a pair of liquid conduit portions, with one of the liquid conduit portions being located on one side of the main portion, and the other of the liquid conduit portions located on an opposite side of the main portion;

the at least one liquid inlet of the liquid dispensing manifold comprises a pair of liquid inlets, with each of said liquid inlets being associated with a respective one of the liquid conduit portions; and the at least one liquid outlet of the liquid dispensing manifold comprises a pair of liquid outlets, with each of said liquid outlets being associated with a respective one of said liquid inlets.

3. The handle according to claim 2, wherein the pair of liquid conduit portions are each made of a length of flexible tubing.

4. The handle according to claim 2, wherein the pair of liquid conduit portions each comprise a telescoping conduit formed of an outer tube and an inner tube that is seated within the outer tube, and wherein each of the inner tubes is configured and arranged to slide within a respective one of the outer tubes.

5. The handle according claim 4, wherein the pair of inner tubes are attached to the proximal side of the liquid dispensing manifold.

6. The handle according to claim 1, wherein the liquid dispensing manifold is completely supported by the at least one liquid conduit portion.

7. The handle according to claim 2, wherein the liquid dispensing manifold is completely supported by the pair of liquid conduit portions.

8. The handle according to claim 1, wherein the liquid dispensing manifold is configured and arranged to provide a continuous flow of liquid from the at least one liquid outlet.

9. The handle according to claim 2, wherein the liquid dispensing manifold is configured and arranged to provide a continuous flow of liquid from the pair of liquid outlets.

10. A shaving device comprising:

a handle; and a blade cartridge that includes a cartridge housing and at least one blade supported by the cartridge housing;

wherein the handle includes:

a main portion configured and arranged to be gripped by a user, wherein the main portion extends from a first end portion to a second end portion thereof;

a nozzle positioned near the second end portion of the main portion of the handle, wherein the nozzle is configured and arranged to introduce a liquid into a cavity within the main portion of the handle;

at least one liquid conduit portion including a proximal end that is in fluid communication with the cavity of the main portion;

a liquid dispensing manifold including a proximal side and a distal side and at least one liquid inlet that is in fluid communication with a distal end of the at least one liquid conduit portion, wherein the liquid dispensing manifold includes at least one liquid outlet, wherein the at least one liquid outlet is in fluid communication with the at least one liquid inlet, and further wherein the at least one liquid outlet is open to the distal side of the manifold;

a first cartridge connecting mechanism provided on the first end portion of the main portion, wherein the first cartridge connecting mechanism is configured to be connected with a handle receiving portion provided on the blade cartridge; and a second cartridge connecting mechanism provided on the distal side of the liquid dispensing manifold, wherein the second cartridge connecting mechanism is configured to be connected with a manifold receiving portion provided on the blade cartridge.

11. The shaving device according to claim 10, wherein:

the at least one liquid conduit portion comprises a pair of liquid conduit portions, with one of the liquid conduit portions being located on one side of the main portion; and the other of the liquid conduit portions located on a opposite side of the main portion;

the at least one liquid inlet of the liquid dispensing manifold comprises a pair of liquid inlets, with each of said liquid inlets being associated with a respective one of the liquid conduit portions; and the at least one liquid outlet of the liquid dispensing manifold comprises a pair of liquid outlets, with each of said liquid outlets being associated with a respective one of said liquid inlets.

12. The shaving device according to claim 11, wherein the pair of liquid conduit portions are each made of a length of flexible tubing.

13. The shaving device according to claim 11, wherein the pair of liquid conduit portions each comprise a telescoping conduit formed of an outer tube and an inner tube that is seated within the outer tube, and wherein each of the inner tubes is configured and arranged to slide within associated a respective one of the outer tubes.

14. The shaving device according claim 13, wherein the pair of inner tubes are attached to the proximal side of the liquid dispensing manifold.

15. The shaving device according to claim 10, wherein in a condition in which the blade cartridge is not attached to either the first cartridge connecting mechanism of the main portion or the second cartridge connecting mechanism of the liquid dispensing manifold, the liquid dispensing manifold is completely supported by the at least one liquid conduit portion.

16. The shaving device according to claim 11, wherein in a condition in which the blade cartridge is not attached to either the first cartridge connecting mechanism of the main portion or the second cartridge attaching connecting mechanism of the liquid dispensing manifold, the liquid dispensing manifold is completely supported by the pair of liquid conduit portions.

17. The shaving device according to claim 10, wherein the liquid dispensing manifold is configured and arranged to provide a continuous flow of liquid from the at least one liquid outlet.

18. The shaving device according to claim 11, wherein the liquid dispensing manifold is configured and arranged to provide a continuous flow of liquid from the pair of liquid outlets.

19. The shaving device according to claim 10, wherein the blade cartridge is configured and arranged to pivot with respect to the main portion of the handle.

20. The shaving device according to claim 19, wherein the liquid dispensing manifold is configured and arranged to synchronously pivot with the blade cartridge.

* * * * *